United States Patent [19]

Zoller

[11] 3,983,274

[45] Sept. 28, 1976

[54] ALUMINUM-COPPER-NICKEL ALLOY FOR THE PRODUCTION OF HEAT RESISTANT PANS AND UTENSILS COATED WITH ENAMELS AND/OR OTHER NON-METALLIC MATERIALS AND CORRESPONDING ALUMINOUS METAL ARTICLES

[75] Inventor: Heinrich Zoller, Benken, Switzerland

[73] Assignee: Swiss Aluminium Ltd., Chippis, Switzerland

[22] Filed: June 8, 1971

[21] Appl. No.: 150,914

[30] Foreign Application Priority Data

June 9, 1970 Switzerland ..... 8615/70

[52] U.S. Cl. ..... 428/35; 75/144; 428/421; 428/463; 428/472

[51] Int. Cl.[2] ..... C22C 21/12

[58] Field of Search ..... 161/189; 75/144, 138, 75/139; 29/197; 117/132 CF, 127; 148/6.27; 428/35, 421, 463, 472

[56] References Cited

UNITED STATES PATENTS 1,960,916 5/1934 Murphy et al. ..... 75/144 X

FOREIGN PATENTS OR APPLICATIONS 734,910 5/1966 Canada ..... 117/132 CF

*Primary Examiner*—David A. Simmons
*Attorney, Agent, or Firm*—Ernest F. Marmorek

[57] ABSTRACT

A method of production of cooking pans and the like, using an aluminum base alloy containing principally 1.2 to 2.3 % copper, 0.3 to 1.2 % nickel and other elements within prescribed ranges, the metal articles made of this alloy being provided with a good adherent coating of enamel directly applied on this metal (e.g. on the outside) and/or of other non-metallic material such as polytetrafluorethylene (e.g. on the inside) and these metal articles showing good thermal resistance at service temperatures.

1 Claim, No Drawings

ALUMINUM-COPPER-NICKEL ALLOY FOR THE PRODUCTION OF HEAT RESISTANT PANS AND UTENSILS COATED WITH ENAMELS AND/OR OTHER NON-METALLIC MATERIALS AND CORRESPONDING ALUMINOUS METAL ARTICLES

Efforts have been made to enamel culinary pans and/or to coat heat-resistant utensils made of aluminum and aluminum alloys with protective material composed mainly of plastic, such as polytetrafluoethylene (Teflon).

To achieve enamelling with good and with high mechanical resistance on aluminum-base alloys, has proved however to be very difficult. One has, for example, used the AlZnMg alloy for this purpose. However, the changeability of the hardened condition of this alloy was a disadvantage when the pans were used at temperatures of about 130°C to over 200°C, because an increased softening of the material occurred due to degeneration of the micro-structure.

A good adhesion of the enamel on the previously used basic alloy could only be achieved by means of an intermediate cladding on the basic material before enamelling. This presented considerable difficulties in the production process.

The object of the present invention is to produce heat-resistant cooking utensils such as pans which have a well adhered enamel, without the necessity of intermediate cladding, and which show high durability at normal utilization temperatures.

According to the invention this objective is achieved by using an AlCuNi alloy containing:

Copper: 1.2 to 2.3%, preferably 1.3 to 1.8%
Nickel: 0.3 to 1.2%, preferably 0.4 to 0.6%
Iron: 0.15 to 1.2%, preferably 0.2 to 0.8%
Magnesium: up to 1.0%, preferably up to 0.8%
Silicon: up to 0.6%
Zinc: up to 0.4% and in which the content of chromium, manganese, vanadium and tungsten is less than 0.1% each, the content of silver and niobium lies below 0.03% and the content of cerium is at the most 0.01%, remainder aluminum, for the production of pans and heat resistant utensils to be enamelled and/or coated with non-metallic material.

By using this alloy, according to the invention, the following special advantages are attained: the strength of hardened alloy (i.e. whether quenched or less quickly cooled, preferably within 15 minutes, from its annealing temperature range of 400° to 550°C down to below 200°C, this at least after the final manufacturing operation above 400°C, and after subsequent cold age-hardening for a period of 14 days) continuously increases with increasing use at temperatures up to approx. 200°C and any disadvantageous warping of the material (for example a warping of the bottom of a pan made of this material) does not occur.

AlNiCuFe alloys in various concentration ranges have already been proposed and used as ductile alloys and the higher contents of Cu, Ni, Mg, Zn, Fe and the other mentioned elements have been regarded as favorable and reliable.

However, for the present purpose, an essential point of the invention is that the contents of Cu, Ni, Mg, Fe, Zn and of the other mentioned elements must not be exceeded because otherwise the said good properties of the said articles will not be achieved.

EXAMPLE

A continuous cast billet (70 × 200 × 1000 mm) of the alloy:

Cu: 1.5%
Mg: 0.5%
Si: 0.4%
Ni: 0.5%
Fe: 0.25%
Other impurities: <0.1%
Al: remainder was annealed at 550°C for 24 hours, then, without intermediate cooling, hot-rolled at 500°C to a 20 mm thick plate which was cold rolled to a 6 mm thick sheet (degree of cold-work: 70%). Discs stamped out of this sheet were stacked up (packetwise), and softened at 350°C for 4 hours, and cooled to less than 200°C in ½ hour.

From each disc a pan was formed by stretch-drawing and then degreased in an alkaline, non-etching bath.

To prepare the said degreasing bath, one may use for instance the commercially available product P 3 T 580 (a product of the firm Henkel) which produces good adhesion of the enamel.

After rinsing with water and drying, a watery enamel slip, composed for example of boric acid, potassium hydroxide, potassium silicate, titanium oxide and one of the commercial frits Al 100 or Al 120 produced by the firm Farbenfabriken Bayer, Leverkusen, was sprayed on to the outside of the pan and dried at 100°C. The enamel was then fired at 540°C (± 10°) for 10 minutes and allowed to cool in still air.

After the pan had cooled, the inside was roughened by sand-blasting and then covered with a layer of Teflon at 420°C, according to a commercially licensed Teflon process, for example, that of the firm Farbwerke Höchst. The pan was then cooled from 420°C to less than 200°C within 10 minutes. Both the enamel and the Teflon layer showed excellent adhesion to the basic material.

After a 14 day cold-ageing period the basic material of the pans produced in this way had a Brinell hardness of about 70 kp/mm² and did not soften after having been used for more than 500 hrs. at a temperature of 200°C.

What is claimed is:

1. A coated aluminous metal article, such as for example a cooking utensil for instance a pan, with good heat resistance, comprising in combination, a shaped metal article composed of an AlCu-Ni alloy with a content of percentages by weight of from 1.2 to 2.3 Cu, from 0.3 to 1.2 Ni, from 0.15 to 1.2 Fe, up to 1.0 Mg, up to 0.6 Si, up to 0.4 Zn, wherein the content of Cr, Mn, V and W is less than 0.1, the content of Ag and Nb is below 0.3, the maximum content of Ce is 0.01, and the remainder is aluminum, and a protective coating of heat resistant inorganic enamel composed of boric acid, potassium hydroxide, potassium silicate, titanium oxide and a commercial frit and of a heat resistant synthetic material disposed directly adjacent the external surface of said shaped article, wherein said synthetic material is polytetrafluoroethylene.

* * * * *